US005323761A

United States Patent [19]

Vartiainen

[11] Patent Number: 5,323,761

[45] Date of Patent: Jun. 28, 1994

[54] VENTILATION APPARATUS

[75] Inventor: Seppo Vartiainen, Mikkeli, Finland

[73] Assignee: Jeven Oy, Mikkeli, Finland

[21] Appl. No.: 862,538

[22] PCT Filed: Jan. 23, 1991

[86] PCT No.: PCT/FI91/00024

§ 371 Date: Jun. 19, 1992

§ 102(e) Date: Jun. 19, 1992

[87] PCT Pub. No.: WO91/11661

PCT Pub. Date: Aug. 8, 1991

[30] Foreign Application Priority Data

Jan. 23, 1990 [FI] Finland ..... 900358
Aug. 15, 1990 [FI] Finland ..... 904034

[51] Int. Cl.[5] ..... F24C 15/20

[52] U.S. Cl. ..... 126/299 D; 454/67; 454/248

[58] Field of Search ..... 126/299 D; 454/46, 67, 454/248, 284, 296, 298, 301, 303

[56] References Cited

U.S. PATENT DOCUMENTS

| | | | |
|---|---|---|---|
| 3,363,532 | 1/1968 | Horneff | 454/296 X |
| 3,457,850 | 7/1969 | Sweet et al. | 126/299 D |
| 4,373,509 | 2/1983 | Neitzel et al. | 126/299 D |
| 4,407,266 | 10/1983 | Molitor | 126/299 D |
| 4,709,623 | 12/1987 | Roth et al. . | |

FOREIGN PATENT DOCUMENTS

| | | | |
|---|---|---|---|
| 36659 | 9/1981 | European Pat. Off. | 126/299 D |
| 254733 | 11/1991 | European Pat. Off. . | |
| 3712297A1 | 10/1988 | Fed. Rep. of Germany . | |
| 793175 | 3/1982 | Finland . | |
| 70319 | 2/1986 | Finland . | |
| 74344 | 9/1987 | Finland . | |
| 74534 | 10/1987 | Finland . | |
| 238932 | 10/1987 | Japan | 126/299 D |
| 334991 | 5/1971 | Sweden . | |
| 523250 | 8/1976 | U.S.S.R. | 126/299 D |
| 1198338 | 12/1985 | U.S.S.R. | 454/296 |
| 1201201 | 8/1970 | United Kingdom . | |

*Primary Examiner*—Harold Joyce
*Attorney, Agent, or Firm*—Merchant, Gould, Smith, Edell, Welter & Schmidt

[57] ABSTRACT

A ventilation apparatus includes an inlet air device (14), an exhaust air device (15) and a mantle (13), which constitutes a hood where the removable air is collected and wherefrom the removable air is discharged by the exhaust air device (15). The inlet air device includes an air distribution chamber, provided with an air distribution surface in connection with the mantle. A fresh incoming air is brought to the air distribution chamber and distributed through the air distribution surface to the air-conditioned space. The inlet air device (14) is formed of a number of inlet air units (10), which are installed at regular intervals from each other, and each inlet air unit is provided with an inlet surface (5) arranged in connection with the mantle, and an air distribution surface (3) which is projected from the inlet surface (5) and is partly permeable to air.

8 Claims, 5 Drawing Sheets

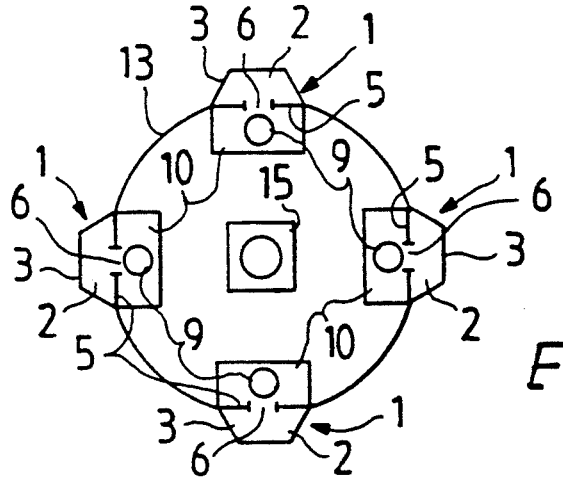
Fig.3
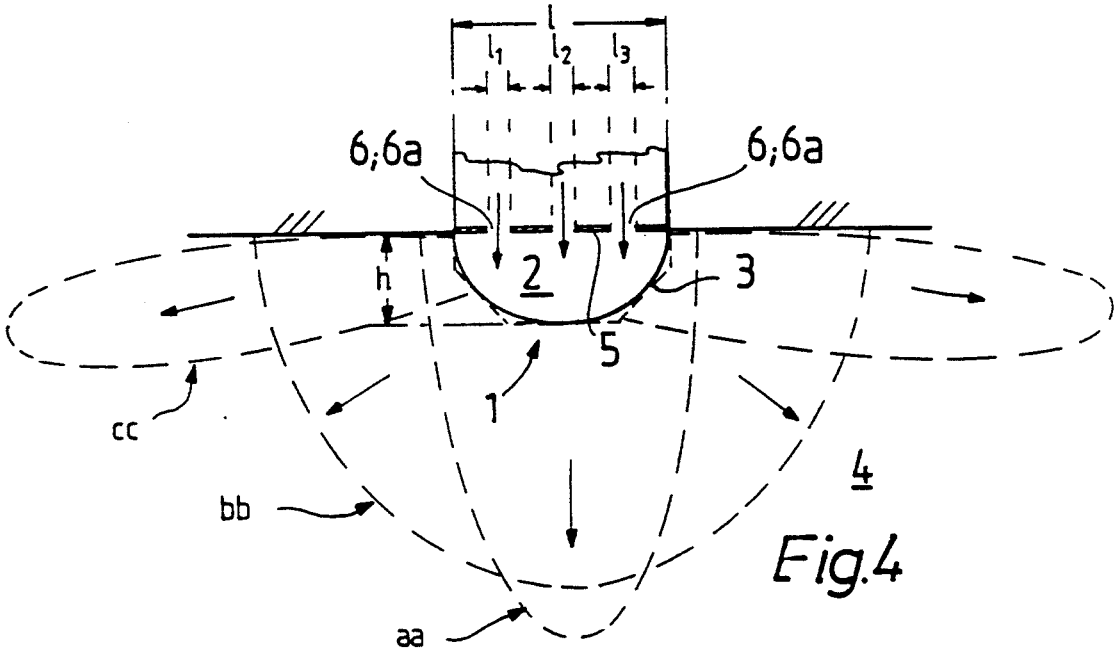
Fig.4
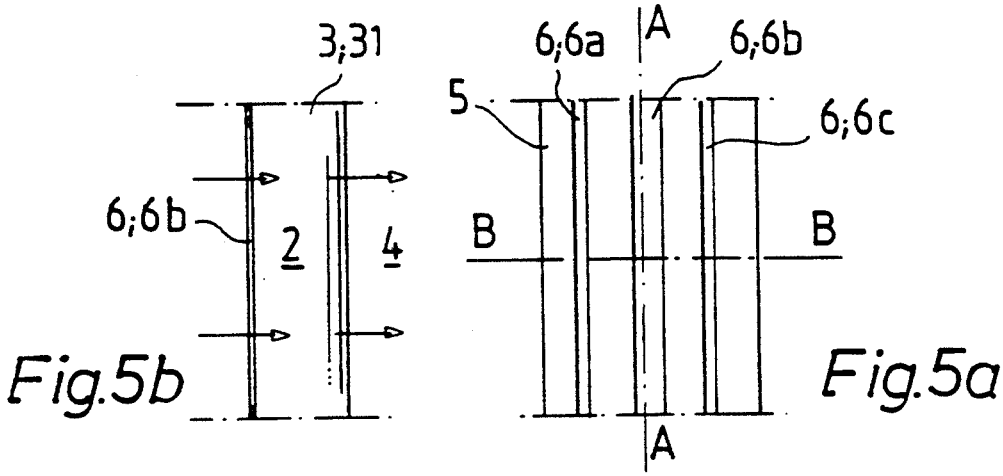
Fig.5b
Fig.5a

VENTILATION APPARATUS

The invention relates to the ventilation apparatus.

In the prior art there is known, from the FI patent publication 74,799, a ventilation apparatus comprising a hood structure. It is deigned particularly for the ventilation of kitchen spaces. The ventilation apparatus is formed of a box-like unit which is rectangular in cross-section, and is arranged In connection to the hood so that from one side surface of the hood, fresh air is distributed into the room space. The exhaust air apparatus is fitted inside the hood.

A drawback with the above described ventilation apparatus is that the inlet air device is installed completely inside the hood structure and thus takes up space in the hood. This kind of inlet air apparatus can also not be arranged on adjacent sides of the hood.

Another drawback is that fresh air is conducted from the inlet air apparatus through the planar air distribution surface directly into the room space, in which case the possibilities for directing the stream of fresh air are limited. The directing requires additional structures such as guiding members, and/or closing of the holes on the outer surface, in the direction where the air stream is not wished to be directed to.

Yet another drawback is that the structures used for evening out the inlet air cause great pressure losses and increase the noise level remarkably.

Yet another drawback is that to adjust the size of the inlet air stream and to distribute it evenly through the long air distribution surfaces to the room space is troublesome.

Yet another drawback is that the air distribution surface is difficult to dismount for cleaning and maintenance.

The object of the invention is to eliminate the above described drawbacks.

A particular object of the invention is to introduce a new ventilation apparatus whereby ventilation is made to function effectively in demanding circumstances, such as catering-size kitchens, and which apparatus is easily realized and modified.

The ventilation apparatus of the invention is characterized by the novel features enlisted in the patent claim 1.

The ventilation apparatus of the invention includes an inlet air device, an exhaust air device and a mantle, which constitutes a hood where the air to be discharged is collected, and where from it is discharged by means of the exhaust air device, the said inlet air device comprising an air distribution chamber, provided with an air distribution surface in connection with the mantle; fresh inlet air is brought into the said air distribution chamber and is distributed to the air-conditioned space through the air distribution surface. According to the invention, the inlet air device is formed of a number of inlet air units, which are installed at regular intervals from each other, and each inlet air unit includes an inlet surface which is arranged in connection with the mantle, as well as an air distribution surface projected from the inlet surface, which air distribution surface is partly permeable to air.

In a preferred embodiment of the apparatus, on the inlet surface of the inlet air unit there is arranged at least one aperture zone, which is relatively narrow with respect to the width of the inlet surface. By means of this aperture zone, both the amount of air and above all the air distribution pattern are adjusted.

In another preferred embodiment of the apparatus, the air distribution chamber of the inlet air unit, the air distribution chamber and its air distribution surface are elongate in form, the inlet surface is parallel to the lengthwise axis of the air distribution chamber, and the inlet surface comprises at least one aperture zone parallel to the lengthwise axis. This kind of inlet air unit is particularly suited for ventilation apparatuses attached to the ceiling, in which case the unit is generally extended from the top end of the hood to the free bottom end thereof. Naturally the air distribution chamber and the air distribution surface thereof may also be of some other shape, for instance essentially round in cross-section on the plane of the inlet surface, either circular or elliptical, so that on the inlet surface there is arranged a number of cocentric and at least partly annular aperture zones, symmetrically with respect to the center point.

In another preferred embodiment of the apparatus, the aperture zone of the inlet air unit comprises one aperture which covers the whole aperture zone.

In another preferred embodiment of the apparatus, the aperture zone includes a number of apertures which are arranged at regular intervals from each other throughout the whole aperture zone, the said apertures covering most advantageously 50% of the total area of the aperture zone.

In another preferred embodiment of the apparatus, the inlet air unit is provided with means for adjusting the aperture zone, particularly the area of the aperture or group of apertures. By adjusting the aperture area, the desired air distribution pattern for the inlet air can be created.

In another preferred embodiment of the apparatus, the said means include one or several members movable in the direction of the inlet surface, such as plates or planes, for adjusting the number of apertures, the area of each aperture zone and particularly the area of the apertures and/or position of the aperture zone.

In another preferred embodiment of the apparatus, the air distribution surface is arranged in connection to the inlet surface, so that it is projected from the inlet surface advantageously in a sector of 180°.

In another preferred embodiment of the apparatus, the air distribution surface is essentially arched and/or polygonal in shape, having the shape of for instance a regular-trapezoid, half-circle, circle segment or the letter U.

In another preferred embodiment of the apparatus, the inlet surface of each inlet air unit constitutes part of the mantle of the ventilation apparatus.

In another preferred embodiment of the apparatus, the inlet air unit comprises an inlet air chamber, and the incoming air is brought into the air distribution chamber through an inlet surface located in between the said inlet air chamber and the air distribution chamber.

In another preferred embodiment of the apparatus, the inlet air units are arranged on adjacent sides of the mantle, the said sides being positioned at angles with respect to each other, most advantageously at right angles.

An advantage of the invention is that it can be widely applied particularly to local ventilation. The structure of the hood is not restricted to the rectangular form, but it may also be, when seen from the top, a polygon, or essentially round, or it may contain both arched and straight sides and parts.

Furthermore, owing to the invention the distribution of inlet air to an air-conditioned space may be carried out through inlet air units which are simple in structure. The inlet air device of the ventilation apparatus of the invention can be realized as a functional and effective module construction. A desired number of similar inlet air units can be arranged in connection with the mantle in order to ensure a sufficient amount of fresh inlet air.

Another advantage of the invention is that by means of each inlet air unit, the directing of the inlet air can be carried out mainly by adjusting the positions of the air jets, i.e. the aperture zone or zones. Thus any separate guiding members are not necessary.

Another advantage of the invention is that the location and cross-section of the air streams coming through the inlet surfaces of each inlet air unit can be adjusted in at least one direction, so that the blowing pattern of the inlet air discharged into the room space from the air distribution chamber is easily and in a simple fashion changed to the desired form. Moreover, by adjusting the width of the air jets, the ratio of the air stream to the room space can be regulated.

Moreover, owing to the invention the area of the air distribution surface of each inlet air unit can be minimized, because inlet air can be directed forward and sideways from the air distribution surface.

Another advantage of the invention is that by means of the inlet air device thereof, and particularly by means of each inlet air unit, there is created an even distribution of the inlet air to the room space, and when necessary a short blowing longitude of air. The blowing pattern of the inlet air obtained from the inlet air unit can be adjusted simply and easily, and there is also created either a slow-velocity or mixing blow pattern. Moreover, the inlet air unit has a low pressure loss and a good noise suppression, and the production of additional noises is minimal.

Yet another advantage of the invention is that the air distribution surface of each inlet air unit can be adjusted to be suitable for the room spaces without thereby causing any essential changes in the blowing or air distribution patterns. Moreover, the inlet air unit is suited to relatively small spaces. Furthermore, the inlet air unit is suitable to be connected directly into the air distribution channel irrespective of the shape of the cross-section of the channel.

The invention is described below with reference to the appended drawings, where

Figure 6A:
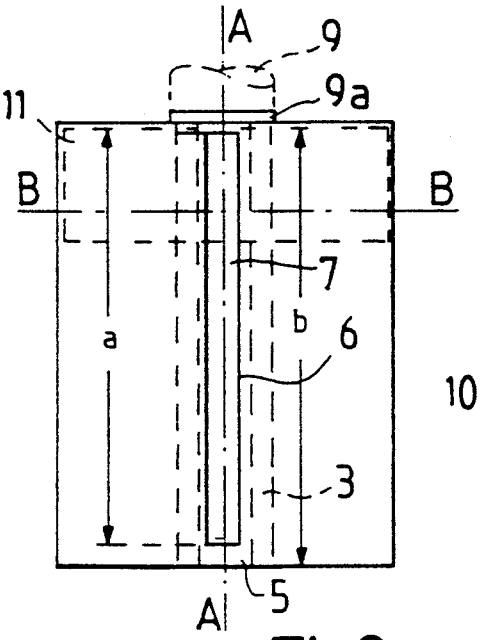
Figure 6B:
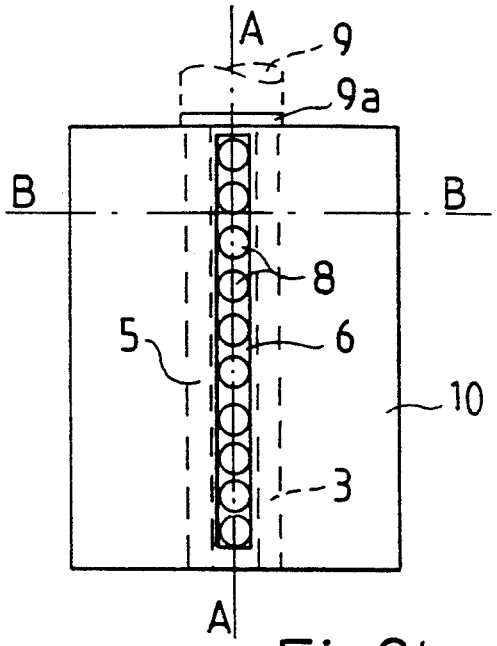
Figure 7A:
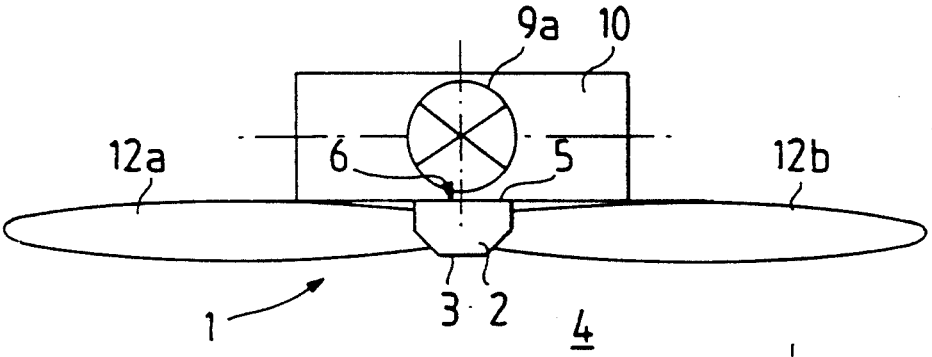
Figure 7B:
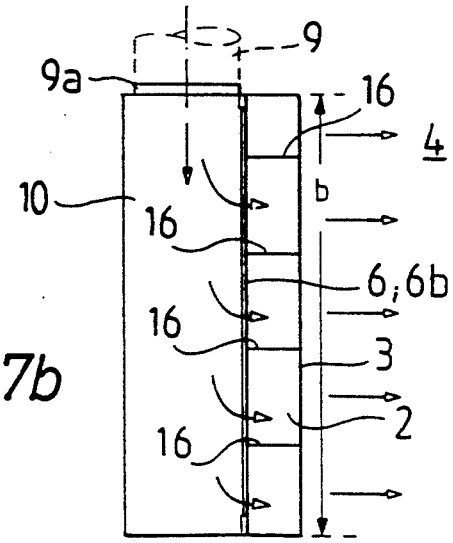

FIG. 3. illustrates another ventilation apparatus of the invention, seen from the top;

FIG. 4 is a schematical cross-sectional illustration of an inlet air unit;

FIG. 5*a* is a partial front-view illustration of an inlet air unit of FIG. 4, shown without the air distribution surface; and FIG. 5*b* illustrates the inlet air unit of FIG. 5*a*, seen in side-view cross-section, provided with the air distribution surface;

FIG. 6*a* is a cross-sectional front-view illustration of another inlet air unit, shown without the air distribution surface;

FIG. 6*b* is a front-view illustration of a third inlet air unit of the invention, shown without the air distribution surface;

FIG. 7*a* is a horizontal cross-section of the inlet air unit of FIG. 6*a* or 6*b*, provided with the air distribution surface;

FIG. 7*b* is a vertical cross-section along the line A—A of the inlet air units of FIGS. 6*a* and 6*b;*

Figure 9A:
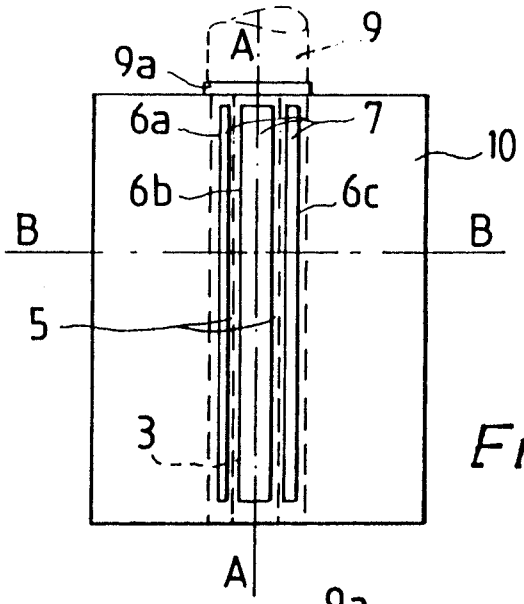
Figure 9B:
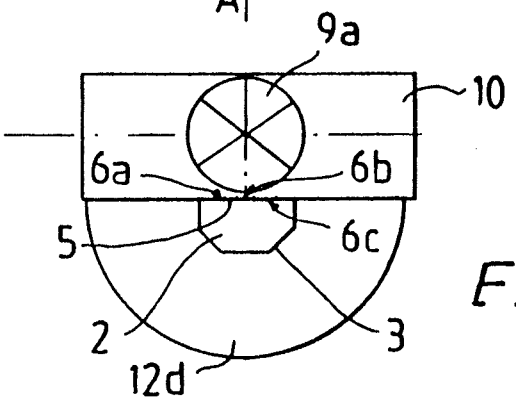
Figure 8A:
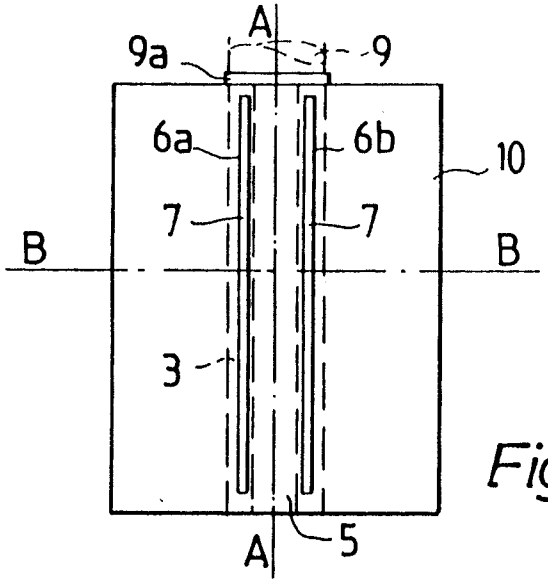
Figure 8B:
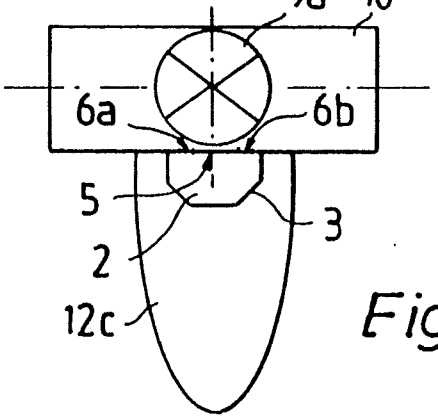
Figure 10A:
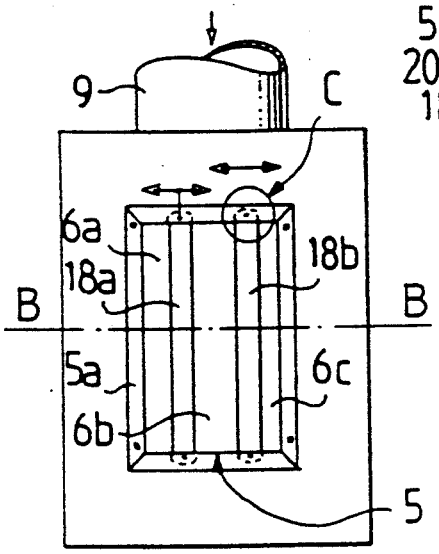
Figure 10B:
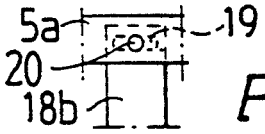

FIG. 8*a* is a front-view illustration of a fourth inlet air unit of the invention, shown without the air distribution surface;

FIG. 8*b* is a horizontal cross-section of the inlet air unit of FIG. 8*a*, provided with the air distribution surface;

FIG. 9*a* is a front-view illustration of a fifth inlet air unit of the invention, shown without the air distribution surface;

FIG. 9*b* is a horizontal cross-section of the inlet air unit of FIG. 9*a*, provided with the air distribution surface;

FIG. 10*a* is a front-view illustration of a sixth inlet air unit of the invention, shown without the air distribution surface;

FIG. 10*b* illustrates the detail C of the inlet air unit of FIG. 10*a;*

Figure 10C:
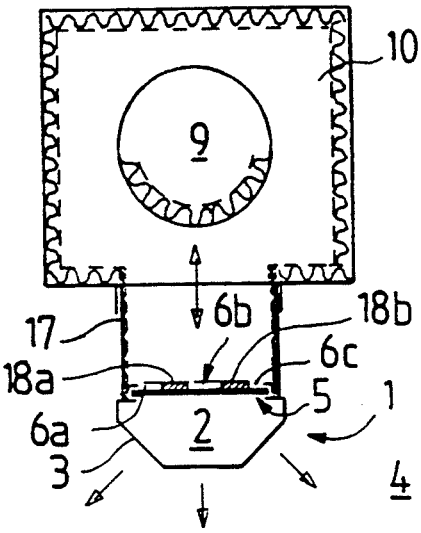
Figure 12:
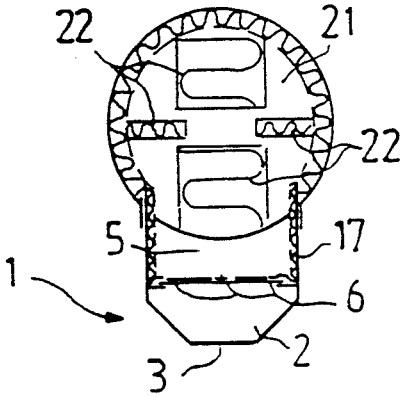
Figure 11:
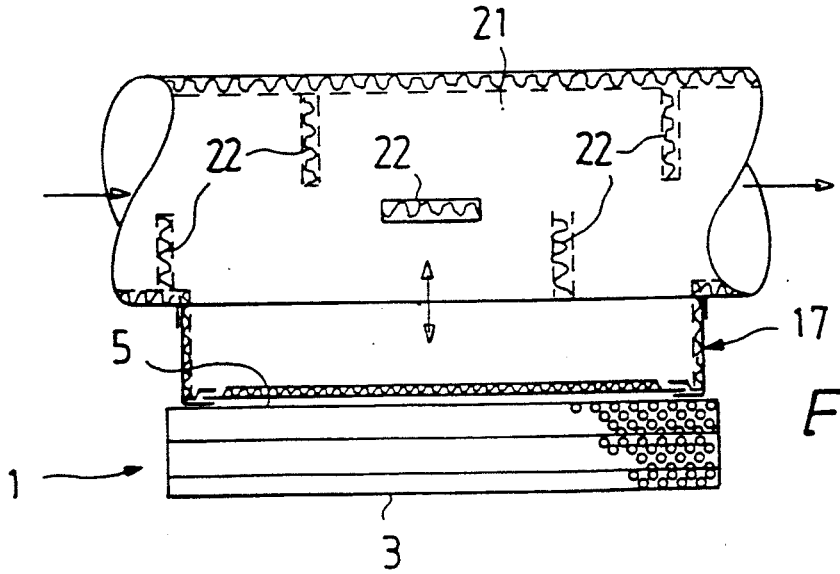

FIG. 10*c* is a cross-sectional illustration of the inlet air unit of FIG. 10*a*, provided with the air distribution surface;

FIG. 11 shows the inlet air unit of the ventilation apparatus of the invention in partial cross-section in the lengthwise direction, as installed in connection with a ventilation channel; and FIG. 12 shows the ventilation channel and inlet air unit of FIG. 11 in cross-section.

Figure 1:
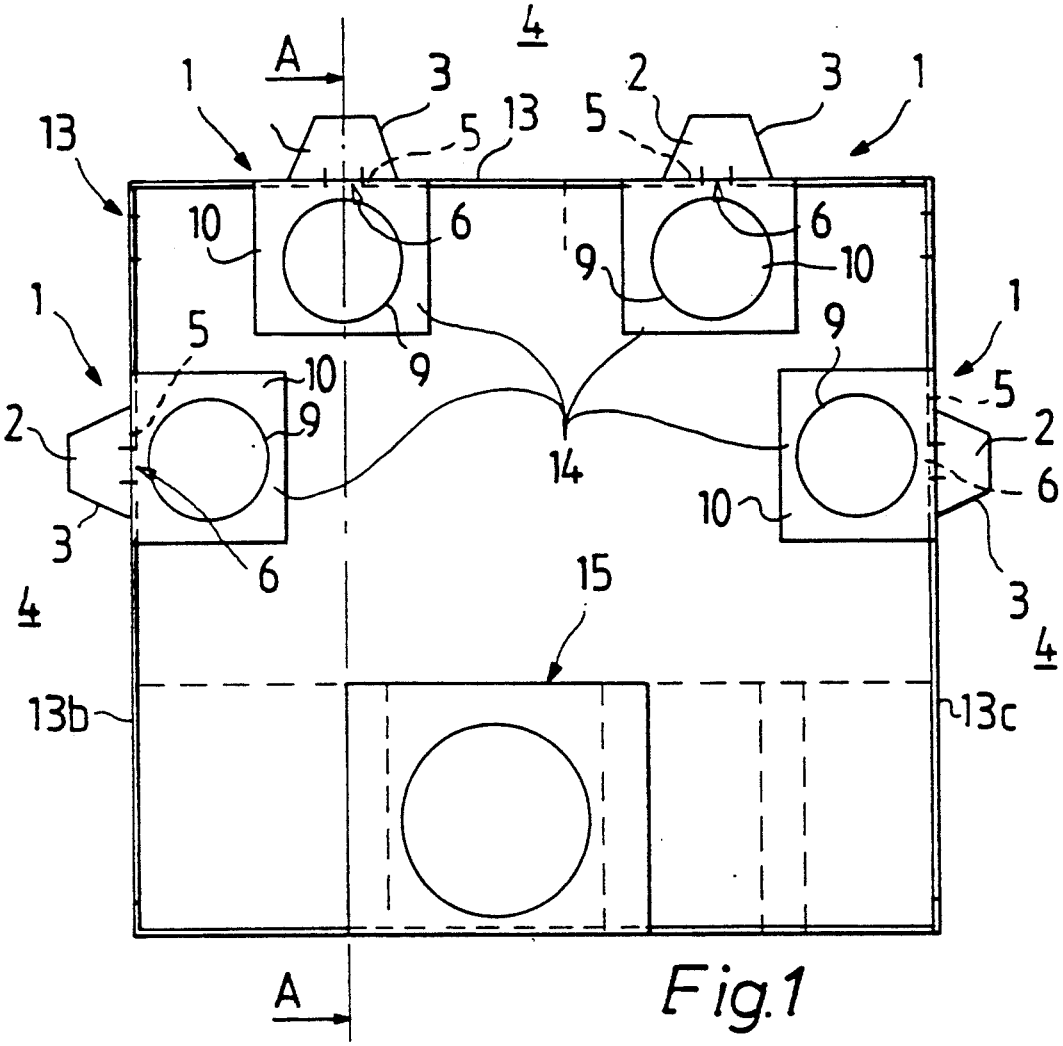
FIG. 1 illustrates a ventilation apparatus of the invention, seen from the top.
Figure 2:
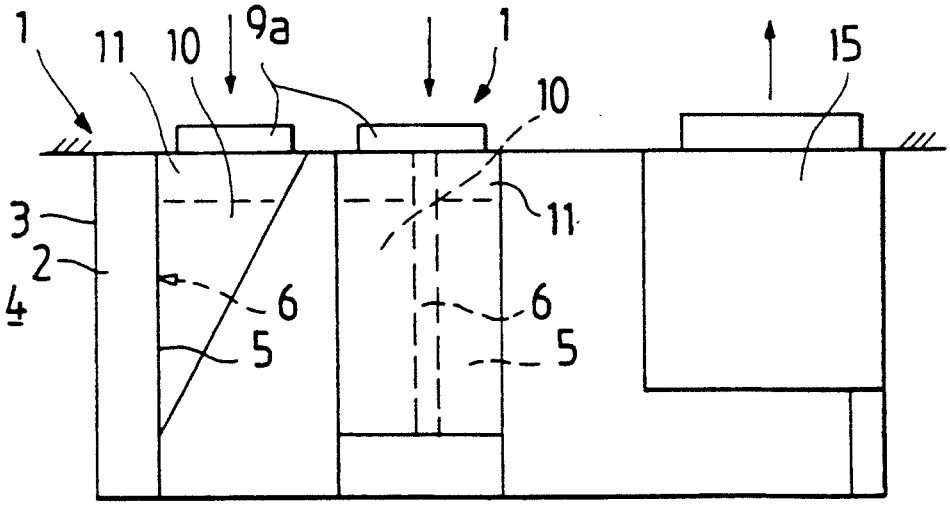
FIG. 2 illustrates the ventilation apparatus of FIG. 1, seen from the side in a partial cross-section A—A.

FIGS. 1 and 2 illustrate a ventilation apparatus particularly suited for ventilation in catering-size kitchens or similar restaurant kitchens. This ventilation apparatus comprises a mantle 13, in connection to which the inlet air device 14 and the exhaust air device 15 are arranged. The mantle 13 constitutes a hood where the air rising from the various functions of the kitchen, particularly from cooking, is collected, and discharged with the exhaust air device 15. Respectively, fresh air is supplied into the kitchen through the inlet air device 14.

The inlet air device 14 is formed of a number of inlet air units 1, which are installed at regular intervals from each other, in the mantle 13. Each inlet air unit 1 comprises an air distribution chamber 2; an inlet air chamber 10; an inlet surface 5, which is arranged in connection with the mantle, advantageously on the same level with it, in between the chambers 2, 10; and an air distribution surface 3, which projected from the inlet surface 5 and the mantle 13, and is partly permeable to air; and the said air distribution chamber is located in between the said inlet surface 5 and the air distribution surface 3.

The air distribution chamber 2 and inlet air chamber 10 of each inlet air unit constitute elongate chambers which in this case are placed in an essentially vertical position. The inlet surface 5 provided in between the chambers 2, 10 forms part of the mantle 13 of the ventilation apparatus. The inlet air chamber 10 Is arranged to be narrowing from one end towards the other end. The inlet air channel 9 is connected to the first end of each inlet air chamber 10.

The inlet surface 5 of each inlet air unit is provided, in the lengthwise direction A—A of the air distribution chamber, with at least one elongate aperture zone 6 with a length essentially equal to that of the air distribution chamber, the said zone being arranged in the middle section of the wall 5 in the transversal direction B—B. Through the aperture zone 6 the chambers 2, 10 are interconnected. The air distribution surface 3 is arranged to be projected from the mantle 13. In this case it is a regular trapezoid in cross-section.

In the ventilation apparatus of FIG. 1, the inlet air units 1 are located on adjacent sides of the mantle, these sides 13*a*, 13*b*, 13*c* being positioned at right angles to each other.

In the ventilation apparatus of FIG. 3, the inlet air units 1 are arranged at regular intervals in the mantle 13 which is essentially circular in cross-section. The exhaust air device 15 is fitted inside the mantle 13, in the middle section thereof.

Naturally the inlet air units 1 of the described ventilation apparatus can be modified in many ways, for instance according to the arrangements explained below with reference to the FIGS. 4–10. Thus the volume of the incoming air flow can be adjusted to a predetermined level. Moreover, the incoming air stream may suitably be focused or distributed to various sides of the ventilation apparatus.

FIGS. 4 and 5*a*, 5*b* are schematical illustrations of the operational principles of the inlet air units of the ventilation apparatus of the invention. In the description below, the reference number 1 is generally applied to the inlet air unit. It comprises an air distribution chamber 2, limited in the direction of the incoming air stream by an inlet surface 5 and by an air distribution surface 3, projected from the inlet surface 5, through which air distribution surface 3 the incoming air stream is distributed into the air-conditioned space 4.

The inlet surface 5 is advantageously a planar surface such as a wall, provided with one or several aperture zones 6 that are narrow at least in one direction. When the widths 11, 12, 13 of the aperture zones are compared to the width 1 of the inlet surface in FIG. 1, it is found out that the widths of the aperture zones in general are clearly smaller than the width of the inlet surface.

In FIGS. 5*a* and 5*b*, the inlet surface 51 of the inlet air unit 1 is an elongate, advantageously rectangular surface. On the inlet surface 51, there are arranged, symmetrically with respect to the lengthwise axis A—A, three aperture zones 6*a*, 6*b* and 6*c*. In this case the air distribution surface 31 is a chute-like outlet surface, projecting from the inlet surface and partly permeable to air.

In cross-section the air distribution surface 3 of the air distribution chamber 2 is most advantageously arched and/or polygonal (dotted lines in FIG. 4). It is essential for the air distribution surface that it most advantageously protrudes from the plane of the inlet surface 5 at relatively right angles, whereafter it is gradually and/or continuously arched towards the center point of the inlet air unit, as is illustrated in FIG. 5*a* and 5*b*, or towards the central axis, as is illustrated in FIGS. 3*a* and 3*b*. In these cases the air distribution surface 3; 30; 31 is symmetrical with respect to its central point 0 and respectively its central axis A—A, but it may also be asymmetrical. With a symmetrical structure, the air distribution pattern can be symmetrically regulated, with respect the center point or the central axis, to either side thereof. Moreover, the air distribution surface 3 is arranged in connection with the inlet surface 5, so that it protrudes from the outlet surface advantageously to form a sector of 180°, as is seen in FIG. 1.

Most advantageously the air distribution surface is realized of perforated plate. The percentage of perforation used in the perforated plate (the area of the holes in relation to the area of the plate ) is generally between 15–40%, advantageously 25–30%.

The aperture zone 6; 6*a*, 6*b*, 6*c* of the inlet surface 5 are formed of uniform apertures, or of a number of separated openings or holes located at regular distances from each other. These openings or holes constitute the major part of the area of the aperture zone, generally about 40–60%, advantageously 50%. The essential point is that the incoming air flow is brought as an essentially uniform air stream through the inlet surface 5, and particularly through the aperture zone 6, to the air distribution chamber 2.

In principle the inlet air unit 1 of FIG. 4 is operated as follows. The incoming air sream is conducted into the air distribution chamber 2 through a suitable air distribution channel or through a connected separate space to behind the inlet surface 5, wherefrom it is brought, as one or several essentially narrow and essentially uniform air Jet to the air distribution chamber 2 via the inlet surface 5. The air jet is allowed to collide, on a desired spot, to the outlet surface 3 which is projected from the plane of the inlet surface 5 and is partly permeable to air. As a consequence of this collision, the inlet air stream entering the room space 4 through the outlet surface 3, is discharged into the room space according to an essentially predetermined air distribution pattern.

In the inlet air unit of FIG. 4, the inlet surface 5 comprises one, two or three aperture zones 6; 6*a*, 6*b*, 6*c*, wherethrough the air jets can be brought into the air distribution chamber 2. This arrangement allows for creating at least three different air distribution patterns, which can, when necessary, be suitably combined to achieve the desired air distribution pattern.

The air distribution pattern aa in FIG. 4, i.e. one narrow, wedge-like air stream discharged mainly directly forward from the air distribution surface 3 is created by placing the aperture zones 6*a*, 6*c* on the periphery of the inlet surface 5, and by closing the central aperture zone 6*b*. Now the air Jets introduced into the air distribution chamber 2 through the aperture zones 6*a*, 6*c* of the air distribution surface 5 follow the peripheral parts of the air distribution surface 3 and collide on the middle section of the air distribution chamber 2 and of the air distribution surface 3, which leads to a powerful discharge of air directly through the air distribution surface 3 outwards, as is schematically illustrated in FIG. 4.

The air distribution pattern bb in FIG. 4, where the air stream is spread in a fanlike pattern throughout the air distribution surface 3, is created when all of the three aperture zones 6*a*, 6*b*, 6*c* are utilized. Now the air Jets enter the air distribution chamber 2 through the aperture zones 6*a*, 6*b*, 6*c* of the inlet surface 5, so that the air jets are mixed in a relatively homogeneous fashion with each other, and are distributed from the air distribution surface evenly to all directions.

The air distribution pattern cc, where two narrow wedgelike streams are directed towards the sides of the air distribution chamber 2, is created when only the middle aperture zone 6*b* is employed. Now the air jet coming through the inlet surface 5 via the aperture zone 6*b* collides force fully against the air distribution surface 3 and is spread towards the sides and discharged into the room space through the air distribution surface as opposing air jets, roughly parallel to the inlet surface 5.

The above described air distribution patterns aa, bb and cc are schematical patterns. It is pointed out that a certain amount of air is discharged through the air distribution surface 3 of the inlet air unit 1 on all sides thereof. This has the advantage that the room space does not meet the air distribution surface, and the impurities of the room space do not pollute and choke the inlet air unit. It is also pointed out that in the elongate inlet air unit of FIGS. 5*a* and 5*b*, the air distribution patterns aa, bb and cc are symmetrical with respect to the axis A—A.

It is further pointed out that the air distribution patterns aa, bb and cc of FIG. 1 are in the inlet air unit of FIGS. 2*a* and 2*b* naturally symmetrical with respect to the central point 0, whereas in the elongate inlet air unit of FIGS. 3*a* and 3*b*, the air distribution patterns are symmetrical in the lengthwise direction with respect to the axis A—A.

It is important for the operation of the inlet air unit of the invention that the air jets are relatively narrow with respect to the width of the inlet surface, and remain relatively unbroken in the air distribution chamber, i.e. follow the forms of the air distribution surface and collide to each other and/or to the air distribution surface in the above described fashion.

The above described operational principle leads to the fact that the inlet air unit of the invention must fulfil certain conditions as for the inlet surface 5 and the air distribution surface 3. Consequently the ratio of the width 1 of the air distribution surface to the height h of the air distribution chamber is generally within the range of 1, 2 . . . 3 : 1, advantageously 1.5 . . . 2 : 1, but other ratios are possible, too. On the other hand, the ratio of the areas of the aperture zones 6 of the inlet surface 5 to the area of the holes in the air distribution surface 3 should most advantageously be 1 : 1, but other ratios are also possible. For instance, the width 1 of the inlet surface 5 may vary between 200–400 mm, and the height h between 60–150 mm.

With reference to the above description, it Is generally maintained that the widths of the aperture zones 6, the location of the aperture zones 6 on the inlet surface 5 with respect to the air distribution surface 3, the form of the air distribution surface 3, the percentage of perforation of the air distribution surface 3 and the ratio of the area of the apertures of the inlet surface to the area of the apertures of the air distribution surface, all have and influence to the distribution of air into the room space, i.e. to the air distribution pattern.

FIGS. 6–9 illustrate various preferred embodiments of the inlet air units 1. The said inlet air unit 1 comprises an elongate air distribution chamber 2, The air distribution chamber 2 is formed of the inlet surface 5 and of an air distribution surface 3 projected therefrom. The incoming air is brought into the chamber 2 through the inlet surface 5, which is provided with one elongate aperture zone 6 in the lengthwise direction A—A of the chamber 2. The length a of this aperture zone 6 essentially corresponds to the length b of the air distribution chamber 2.

In the embodiments of FIGS. 6*a*, 6*b*, 7*a* and 7*b*, the inlet surface 5 of the Inlet air unit 1 is provided with one aperture zone 6, which is arranged in the middle of the chamber wall, in the transversal direction B—B of the chamber. In FIG. 6*a*, the aperture- zone 6 comprises one aperture 7, which covers the whole aperture zone. Alternatively the aperture zone 6 constitutes a number of apertures 8, which are arranged at regular intervals from each other, as is illustrated in FIG. 6*b*. Advantageously these apertures cover at least 50% of the total area of the aperture zone 6.

Inside the air distribution chamber 2 of the inlet air unit 1, there are advantageously installed intermediate plates 16 which are transversal to the axis A—A, as is illustrated in FIG. 7*b*, the said plates being located at suitable intervals from each other. The purpose of these intermediate plates 16 is to realign the air stream discharged from the inlet air channel 9, so that it is directed, roughly at right angles with respect to the incoming stream, out of the Inlet air unit 1. Owing to the intermediate plates 16, there is created an underpressure therebelow, and this underpressure straightens the air stream directed outwards.

In the embodiment of FIGS. 6*a*, 6*b*, 7*a* and 7*b*, the area of the aperture 7 or apertures 8 of the aperture zone 6, is advantageously 0.8 x the total area of the holes of the air distribution surface 3. This ratio of the apertures 7, 8 to the holes of the air distribution surface makes it possible to realize the air distribution pattern of FIG. 7*a*, where air is directed as two zones 12*a* , 12*b*, powerfully to opposite directions from the air distribution chamber, essentially at an angle of 90° with respect to the aperture zone 6 and roughly parallel to the chamber wall.

In the embodiment of FIGS. 8*a* and 8*b*, the inlet surface 5 of the inlet air unit 1 is provided with two adjacent aperture zones 6*a* and 6*b*, which are arranged in the transversal direction B—B of the chamber 2, in the middle section of the wall 5, symmetrically with respect to the central line A—A and at suitable distances from each other.

In the embodiment of FIGS. 8*a* and 8*b*, the area of the apertures 7 (or 8; cf. FIG. 6*b*) of the aperture zones 6*a* and 6*b* is advantageously between 0.6 . . . 0.8 x the total area of the holes in the air distribution surface 3 . The said ratio of the apertures 7, 8 to the holes of the air distribution surface allows for realizing the air distribution pattern of FIG. 6, where air is directed powerfully as one flow 12*c* from the air distribution chamber 2 essentially forward, and at the same time to the normal direction with respect to the aperture zone 6 and the wall 5.

In the embodiments of FIGS. 9*a* and 9*b*, the wall 5 or the inlet air unit 1 is provided with three adjacent aperture zones 6*a*, 6*b* and 6*c*, which are arranged, in the transversal direction B—B of the chamber 2, in the middle section of the wall 5, symmetrically with respect to the central line A—A, and at a suitable distance from each other.

In the embodiments of FIGS. 9*a* and 9*b*, the area of the apertures 7 (or respectively 8) of the aperture zones 6*a*, 6*b* and 6*c* is advantageously between 1.2 . . . 1.6 x the total area of the holes of the air distribution surface 3. This ratio of the apertures 7, 8 to the holes of the air distribution surface makes it possible to realize the air distribution pattern of FIG. 7*a*, where air is directed as one flow 12*d*, roughly evenly from the air distribution chamber 2 outwards in a sector of 180°.

The aperture zone 6*a*, 6*b*, 6*c* comprises either one aperture 7 covering the whole aperture zone, or a number of apertures 8, as in FIG. 6*b*, which are arranged at regular intervals from each other along the whole aperture zone. These apertures 8 advantageously cover 50% of the total area of the aperture zone.

In the embodiments of FIGS. 6–9, the inlet air unit 1 also comprises an inlet air chamber 10. The inlet air chamber 10 is connected, with a collar 9*a*, to the inlet air channel 9, wherethrough fresh air is supplied into the inlet air unit. In the drawings the collar 9a is placed in the top part of the inlet air chamber, but it may also be placed on any of the sides of the inlet air chaser, or In the bottom part thereof. In between the inlet air chamber 10 and the air distribution chamber 2, there is provided an inlet surface 5, where the aperture zone 6 is arranged.

The inlet air chamber 10 of the inlet air unit 1 can be easily provided with a silencing member 11, as in FIG. 10c, which silencing member prevents noises from being carried to other parts of the building along the inlet air channel.

The air distribution surface 3 of the inlet air unit is advantageously detachably fastened to the inlet surface 5, or generally in connection thereto. The employed connecting members may be for instance machine screws or suitable known bayonet catch arrangements. This facilitates the erecting and maintenance of the inlet air unit.

The air distribution surface 3 is formed of perforated plate, where the proportion of the area of the holes in the total area of the surface is 15% in the embodiments of FIGS. 1–6. The corresponding area ratio of the air distribution surface may, however vary between for example 5% . . . 40%.

The air distribution surface 3 is symmetrical in cross-section, having the shape of for instance a trapezoid (cf. FIGS. 6 and 8 ), a half-circle, circle segment or essentially that of the letter U. Thus the air distribution pattern of the inlet air unit is made symmetrical in the transversal section of the apparatus. It is naturally clear that asymmetrical air distribution surfaces may also be used, for instance when the desired air distribution pattern Is fitted within a certain sector, where the angle of opening is smaller than 180°.

FIGS. 10a, 10b and 10c illustrate an embodiment of the inlet air unit 1, also provided with the inlet air chamber 10. In this case the inlet air unit 1 is connected, by means of a connecting duct 17, to the inlet air chamber 10. The connecting duct 17 is advantageously telescopic, i.e. it can be pushed into the inlet air chamber 10, or drawn out therefrom. In between the connecting duct 17 and the air distribution chamber 3 there is located the inlet surface 5.

In this case the inlet surface 5 is an aperture, where plates 18a, 18b are installed. The plates 18a, 18b constitute means for adjusting the aperture zones 6a, 6b and 6c of the inlet surface 5. At their top ends the plates 18a, 18b are provided with transversal runners 19, and by means of screws 20 inserted through these runners the plates can be secured in place in a desired position to the frame 5a of the inlet surface, or to a corresponding structure, as well as released and readjusted. By employing the plates 18a, 18b, both the position and width of the aperture zones 6a, 6b and 6c can be adjusted in order to achieve the desired air distribution pattern, as was explained for example in connection to FIG. 4.

The plates 18a, 18b in FIG. 10 can be arranged to be in contact with each other in the middle of the inlet surface 5, in which case two aperture zones 6a and 6c are formed along the sides. In this fashion there is created the air distribution pattern aa or 12c respectively.

When the plates 18a, 18b are arranged In the position of FIG. 10, there are created three aperture zones 6a, 6b and 6c. By employing these, there is realized the air distribution pattern bb or 12d of FIGS. 4 or 9b respectively.

If the plates 18a, 18b are arranged on the sides of the inlet surface 5, in the middle of the inlet surface 5 there is formed one aperture, i .e . one aperture zone 6b. Thus the air distribution pattern cc or 12b, of FIG. 4 or 7a respectively, can be created.

In the above described embodiment of the inlet air unit of FIG. 10, the inlet surface 5 Is connected to the inlet channel 10 by means of the connecting duct 17. Thus the cross-sectional area of the inlet surface, i.e. that of the aperture, advantageously corresponds to the cross-sectional area of the connecting duct 17. It is, however, clear that the inlet air unit of FIG. 10 may also be applied according to the FIGS. 6–9, and be directly connected to the inlet chamber 10 or the like, and its inlet surface 5 can be adjusted by means of the above described methods, among others.

In the above described embodiments of the invention, the air distribution chamber 2 of the inlet air unit 1 is connected, via the aperture zone 6 and the inlet air chamber 10, to the inlet air channel 9. The air distribution chamber 2 can also be connected directly to the inlet air channel. In that case the inlet surface 5 of the inlet air unit 1 is advantageously formed of the casing of the inlet air channel, where one or several aperture zones 6 are provided. Alternatively the inlet air unit 1 is connected, by means of the connecting duct 17, to the inlet air channel 21, as is illustrated in FIGS. 11 and 12. Even in this case the connecting duct 17 is advantageously adjustable, i.e. it can, when necessary, be partly pushed into the inlet air channel 21, or drawn out thereof depending for example of the installations in hand. Also in this case like reference numbers as before are used of like parts of the inlet unit 1. In the inlet air channel 21, in the vicinity of the inlet air unit 1, there can be provided silencing elements 22, which are advantageously placed transversally with respect to the flow in the channel, or transversally with respect to the flow entering the inlet air unit.

In the above described preferred embodiments of the invention, the inlet air unit 1 is arranged in connection with the inlet air device, generally in a vertical position, as Is seen for instance in FIGS. 1, 2 and 3. It is, however, pointed out that the inlet air unit 1 can also be installed for example in a horizontal position in the mantle 13 of the inlet air device, and be arranged to encircle the ventilation apparatus at least partly, either as one unit or as several adjacent and/or successive elements.

The invention is not limited to the preferred embodiments described above, but many modifications are possible within the scope of the inventional idea represented in the appended patent claims.

I claim:

1. A ventilation apparatus, comprising:

an inlet air device (14);

an exhaust air device (15);

a mantle (13) constituting a hood, a removable air being collected to the hood, and the removable air being discharged by means of the exhaust air device (15);

the inlet air device (14) being formed of a number of inlet air units (1), the inlet air units being arranged at regular intervals from each other;

each inlet air unit comprising an inlet air chamber (10) and an air distribution chamber (2) provided with an air distribution surface (3), the air distribution surface being partly permeable to air and being in connection with the mantle (13), a fresh incoming air being brought through the inlet air chamber (10) to air distribution chamber and being distributed through the air distribution surface (3) to an air-conditioned space;

an inlet surface (5) being planelike and being arranged in the same level with the mantle (13), between the inlet air chamber (10) and the air distribution chamber;

at least one elongate aperture zone (6; 6*a*; 6*b*; 6*c*) having a length substantially equal to that of the air distribution chamber (2), the elongate aperture zone being disposed in a lengthwise direction of the inlet air chamber (10) on the inlet surface (5);

the air distribution surface (3) being arched in shape and a ratio of a width of the air distribution surface (3) to a height of the air distribution chamber (2) is within a range of 1:1, 2:1 to 3:1; and the air distribution surface (3) being projected from the inlet surface (5) and being disposed in said arched shape.

2. The apparatus of claim 1, wherein the aperture zone (6; 6*a*; 6*b*; 6*c*) comprises one aperture (7) which covers the whole aperture zone.

3. The apparatus of claim 1, wherein the apparatus is provided with means for adjusting the aperture zone (6; 6*a*; 6*b*; 6*c*) and at least one aperture of the aperture zone.

4. The apparatus of claim 3, wherein the said means include at least one member (18*a*, 18*b*) movable in the direction of a wall, for adjusting a number of the aperture zone, an area of each aperture zone and an area and a position of an individual aperture in the aperture zone.

5. The apparatus of claim 1, wherein the inlet surface (5) of each inlet air unit (1) constitutes a part of the mantle (13) of the ventilation apparatus.

6. The apparatus of claim 1, wherein the inlet air units (1) are placed on adjacent sides of the mantle, positioned at an angle to each other.

7. The apparatus of claim 1, wherein the inlet air units are placed on adjacent sides of the mantle, positioned at right angles.

8. A ventilation apparatus, comprising:

an inlet air device (14);

an exhaust air device (15);

a mantle (13) constituting a hood, a removable air being collected to the hood, and the removable air being discharged by means of the exhaust air device (15);

the inlet air device (14) being formed of a number of inlet air units (1), the inlet air units being arranged at regular intervals from each other;

each inlet air unit comprising an inlet air chamber (10) and an air distribution chamber (2) provided with an air distribution surface (3), the air distribution surface being partly permeable to air and being in connection with the mantle (13), a fresh incoming air being brought through the inlet air chamber (10) to air distribution chamber and being distributed through the air distribution surface (3) to an air-conditioned space;

an inlet surface (5) being planelike and being arranged in the same level with the mantle (13), between the inlet air chamber (10) and the air distribution chamber;

at least one elongate aperture zone (6; 6*a*; 6*b*; 6*c*) having a length substantially equal to that of the air distribution chamber (2), the elongate aperture zone being disposed in a lengthwise direction of the inlet air chamber (10) on the inlet surface (5);

the air distribution surface (3) being polygonal in shape and a ratio of a width of the air distribution surface (3) to a height of the air distribution chamber (2) is within the range of 1:1, 2:1 to 3:1; and the air distribution surface (3) being projected from the inlet surface (5) and being disposed in said polygonal shape.

* * * * *